US011491620B2

(12) United States Patent
Donner

(10) Patent No.: US 11,491,620 B2
(45) Date of Patent: Nov. 8, 2022

(54) SETTING TOOL, SET FOR A SETTING TOOL SYSTEM AND SETTING TOOL SYSTEM

(71) Applicant: Hilti Aktiengesellschaft, Schaan (LI)

(72) Inventor: Tobias Donner, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 314 days.

(21) Appl. No.: 16/619,799

(22) PCT Filed: Jun. 22, 2018

(86) PCT No.: PCT/EP2018/066760
§ 371 (c)(1),
(2) Date: Dec. 5, 2019

(87) PCT Pub. No.: WO2019/007708
PCT Pub. Date: Jan. 10, 2019

(65) Prior Publication Data

US 2020/0130155 A1 Apr. 30, 2020

(30) Foreign Application Priority Data

Jul. 5, 2017 (EP) ..... 17179761

(51) Int. Cl.
*B25B 31/00* (2006.01)
*B25B 13/06* (2006.01)
*B25B 23/00* (2006.01)

(52) U.S. Cl.
CPC ..... *B25B 31/00* (2013.01); *B25B 13/065* (2013.01); *B25B 23/0035* (2013.01)

(58) Field of Classification Search
CPC ... B25B 31/00; B25B 13/065; B25B 27/0007; B25B 23/0035; B25B 13/06;
(Continued)

(56) References Cited

U.S. PATENT DOCUMENTS 2,969,250 A * 1/1961 Kull ..... B25B 13/065 403/350
3,979,918 A 9/1976 Vidler
(Continued)

FOREIGN PATENT DOCUMENTS

DE 10 2013 008 653 11/2014
JP S55-151470 U 10/1980
(Continued)

OTHER PUBLICATIONS

English translation of Russian publication No. RU 36040U1, published on Feb. 20, 2004.
(Continued)

*Primary Examiner* — David B. Thomas
*Assistant Examiner* — Jason Khalil Hawkins
(74) *Attorney, Agent, or Firm* — Grüneberg and Myers, PLLC

(57) ABSTRACT

A setting tool for a setting tool system for setting capsule anchors is specified, having a shank and a head, arranged at one end of the shank, with a recess for receiving a drive head of a capsule anchor, wherein the shape of the recess is formed substantially by two superimposed hexagons that are arranged in an offset manner to one another. Further, a set for a setting tool system for setting capsule anchors is specified, having an adapter which is able to be coupled to a drive machine, and at least one setting tool. Moreover, a setting tool system is specified, including a setting tool for a setting tool system for setting capsule anchors or a set for a setting tool system for setting capsule anchors, and a capsule anchor and/or a drive machine.

13 Claims, 5 Drawing Sheets

(58) Field of Classification Search
CPC ..... B25B 21/007; F16B 13/143; B25D 2216/0023; B25D 17/005
USPC ..... 81/436–461
See application file for complete search history.

(56) References Cited

U.S. PATENT DOCUMENTS

| | | | | |
|---|---|---|---|---|
| 4,459,074 | A * | 7/1984 | Capuano | F16B 23/0007 411/403 |
| 4,646,594 | A | 3/1987 | Tien | |
| 4,671,141 | A * | 6/1987 | Hanson | B25B 13/48 81/53.2 |
| 5,368,164 | A * | 11/1994 | Bennett | B25H 3/003 206/373 |
| 5,848,694 | A * | 12/1998 | Newton | B25H 3/003 206/373 |
| 6,626,067 | B1 * | 9/2003 | Iwinski | B25B 13/065 411/403 |
| 7,267,032 | B1 * | 9/2007 | Keller | B25B 13/481 81/436 |
| 8,545,156 | B2 | 10/2013 | Kageyama et al. | |
| 8,549,963 | B2 * | 10/2013 | Chuang | B25B 15/02 81/475 |
| 8,607,672 | B2 * | 12/2013 | Urick | B25B 13/06 81/121.1 |
| 9,144,893 | B2 * | 9/2015 | Su | B25B 13/56 |
| 10,202,998 | B2 | 2/2019 | Rosenkranz et al. | |
| 10,780,508 | B2 * | 9/2020 | Foser | B25D 17/005 |
| 11,192,222 | B2 * | 12/2021 | Prunean | B25B 23/00 |
| 2002/0104409 | A1 * | 8/2002 | Hu | B25B 13/04 81/124.3 |
| 2005/0034569 | A1 | 2/2005 | Junkers | |
| 2009/0180839 | A1 * | 7/2009 | Kardas | B25B 23/141 405/259.1 |
| 2009/0264896 | A1 * | 10/2009 | Biedermann | A61B 17/7076 606/104 |
| 2011/0011218 | A1 | 1/2011 | Hsieh | |
| 2011/0259158 | A1 | 10/2011 | Richardson | |
| 2012/0074659 | A1 * | 3/2012 | Fanourgiakis | B25B 31/00 279/145 |
| 2012/0099944 | A1 | 4/2012 | Kageyama et al. | |
| 2012/0137837 | A1 | 6/2012 | Souma | |
| 2013/0161038 | A1 | 6/2013 | Prunean | |
| 2014/0196581 | A1 * | 7/2014 | Su | B25B 13/56 81/438 |
| 2014/0360318 | A1 * | 12/2014 | Cutler | B25B 23/0057 81/124.1 |
| 2015/0135504 | A1 * | 5/2015 | East | B25B 27/0035 29/426.5 |
| 2015/0135910 | A1 | 5/2015 | Eggert et al. | |
| 2015/0273670 | A1 | 10/2015 | Cheng | |
| 2016/0053792 | A1 | 2/2016 | Rosenkranz et al. | |
| 2018/0161038 | A1 | 6/2018 | Lorenzo | |
| 2020/0391363 | A1 * | 12/2020 | Donner | B25B 13/06 |

FOREIGN PATENT DOCUMENTS

| | | |
|---|---|---|
| JP | H02-39874 | 3/1990 |
| JP | H03-161285 | 7/1991 |
| JP | 2004034177 | 2/2004 |
| JP | 2012-115975 | 6/2021 |
| KR | 10-2013-0075250 | 7/2013 |
| RU | 2160936 | 12/2000 |
| RU | 2199034 | 2/2003 |
| RU | 2513676 | 4/2014 |

OTHER PUBLICATIONS

International Search Report dated Oct. 10, 2018 in PCT/EP2018/066760 with English translation (5 pages).
Written Opinion dated Oct. 10, 2018 in PCT/EP2018/066760.

* cited by examiner

SETTING TOOL, SET FOR A SETTING TOOL SYSTEM AND SETTING TOOL SYSTEM

This application is a National Stage entry under § 371 of International Application No. PCT/EP2018/066760, filed on Jun. 22, 2018, and which claims the benefit of European Application No. 17179761.6, filed on Jul. 5, 2017.

BACKGROUND OF THE INVENTION

Field of the Invention

The present invention relates to a setting tool and to a set for a setting tool system and to a setting tool system for setting capsule anchors.

Capsule anchors are chemical anchors that are used to fasten heavy loads, predominantly in substrata composed of concrete. In order to set a capsule anchor, a capsule is inserted into a cleaned borehole. Subsequently, an anchor rod of the capsule anchor is introduced into the borehole provided with the capsule, by rotating it, wherein the capsule breaks and releases at least two components that are mixed by means of the rotation of the anchor rod, and subsequently react chemically with one another. As a result, a force-fit and shape-fit connection of the capsule anchor with the substratum, in particular the surroundings of the borehole, takes place.

To set a capsule anchor, a setting tool and a drive machine, as well as a borehole, a capsule, and an anchor rod are required. The setting tool is configured for transferring a movement of the drive machine to the capsule anchor.

When setting capsule anchors, great forces are sometimes in effect, such as forces caused by axial impacts, and thereby a head geometry of the capsule anchor is plastically deformed and the capsule anchor can become wedged in the setting tool. In this case, the setting tool can only be removed from the capsule anchor when the mixed components have completely cured, since otherwise, fastening of the capsule anchor in the substratum could be weakened. During this time, the setting tool cannot be used, and this leads to significant delays in the process in the case of series applications. For this reason, multiple setting tools are frequently provided for series applications, but this leads to high acquisition costs.

Furthermore, different setting tools are required for anchor rods of different sizes in the case of series applications, and this also increases the acquisition costs.

SUMMARY OF THE INVENTION

It is therefore the task of the present invention to make available an optimized setting tool that can be quickly released from a capsule anchor after a setting procedure, without impairing the strength of the connection of the capsule anchor in the substratum, a set, and a corresponding setting tool system, with which capsule anchors of different sizes can also be installed quickly. Furthermore, it is the task of the present invention to make available a flexible setting tool that is suitable for use with a percussion drill or with a cordless drill/screwdriver.

This task is accomplished, according to the invention, by means of a setting tool for a setting tool system for setting capsule anchors, having a shaft and a head arranged at one end of the shaft, with a recess for holding a drive head of a capsule anchor, wherein the shape of the recess is essentially formed by two hexagons that are superimposed on one another and arranged offset relative to one another.

Transfer of a torque is positively influenced by such a geometry of the recess of the setting tool. Furthermore, easy setting down and release are made possible. In particular, plastic deformation of the contour of the recess or of the drive head of the capsule anchor is prevented, i.e. the flow behavior is influenced, so that the setting tool and the capsule anchor do not become wedged into one another. In this regard, the setting tool can be released from the capsule anchor particularly easily after the setting procedure. This guarantees that the curing process is not disrupted by removal of the setting tool, since only comparatively low forces are transferred to the capsule anchor when the setting tool is released. In this regard, one also speaks of high setting performance. The property of the system of efficiently holding a capsule anchor, setting it, and being released again is referred to as high setting performance. This means that the setting tool can be lifted up off the capsule anchor again once the setting depth has been reached, without having to be released by means of stronger or repeated rolling or pitching movements of the setting tool, which would disrupt the curing process. As a result, productivity is clearly increased, in particular in the case of series application.

The two superimposed hexagons, which essentially define the shape of the recess, are arranged offset relative to one another in a common plane. In particular, the recess is formed by two partial recesses having a hexagonal base surface, which are merged with one another to define the recess, wherein the base surfaces of the two hexagons or partial recesses lie in a plane. This plane is particularly perpendicular to a center axis of the setting tool. In this manner, it is prevented that the setting tool and the capsule anchor tilt sideways relative to one another during the setting process; this would significantly impair the transfer of force and could lead to wedging.

According to a preferred embodiment, the center points of the two superimposed hexagons lie one on top of the other. This arrangement proves to be particularly advantageous in the case of low-wear transfer of a torque. In particular, the center points of the hexagons lie on the center axis of the setting tool. As a result, the recess is arranged centered in the head of the setting tool, and thereby an eccentric transfer of torque when setting the capsule anchor is avoided.

The hexagons can be arranged rotated relative to one another by an angle between 5° and 15°, in particular between 8° and 13°. The axis of rotation coincides with the center axis of the setting tool. Preferably, the hexagons are arranged rotated relative to one another by 10°. In the case of such an arrangement of the hexagons, the setting performance of the setting tool is particularly high. Due to the rotated arrangement of the two hexagons relative to one another, the corners of one hexagon project beyond the sides of the other hexagon. As a result, the corresponding shape of the recess for good setting performance of the setting tool occurs.

Furthermore, the regions between directly adjacent corners of the two hexagons, which are offset relative to one another, in particularly rotated, can also be cut out so as to be part of the recess. As a result, sharp edges or peaks in the edge geometry of the recess are avoided, since these are correspondingly flattened out.

As has already been explained, the recess is formed by two partial recesses, each having a hexagonal base surface, wherein the two partial recesses are offset relative to one another, in particular rotated relative to one another, wherein they have a common axis of symmetry. The peaks that occur as a result between two directly adjacent corners of the two hexagons are correspondingly flattened out, so that the related regions are part of the recess.

For example, the hexagons are configured to be equilateral, in each instance. As a result, a force that acts on each side wall of a corresponding hexagon during a setting process can be approximately the same. In this way, it is furthermore prevented that the drive head of a capsule anchor is subject to non-uniform stress. In this regard, plastic deformation of the drive head is effectively minimized.

Preferably, the hexagons are regular, in each instance. This has a positive influence on the setting performance of the setting tool.

In particular, the hexagons form a recess configured as a hexagonal socket, in each instance. Thereby the setting tool can interact with a corresponding external hex of a capsule anchor.

According to one embodiment, the hexagons have circumference radii of different sizes. The hexagons can be defined by way of a corresponding circle. A different radius of the circumference results in a correspondingly different base surface of the hexagons in the case of regular hexagons, for example. In this regard, the hexagons can have a base surface of a different size. In this regard, the smaller hexagon can be configured to hold the drive head of a capsule anchor with shape fit, so as to effectively and homogeneously transfer a torque to the capsule anchor. By means of the larger hexagon, free spaces occur between the drive head of a capsule anchor and an inner wall of the recess, if a capsule anchor is in engagement with a setting tool. These free spaces can serve to release the setting tool from the capsule anchor more easily. In this regard, the part of the recess that is formed by a first (smaller) hexagon serves for transfer of torque, in particular the contour of the corresponding partial recess, whereas the part of the recess that is formed by the second (larger) hexagon, serves for more easily releasing the setting tool from the capsule anchor, after the capsule anchor has been set.

Alternatively, the two hexagons can also have the same circumference radii, so that they each have base surfaces of the same size. In this regard, two equal partial recesses are present, which each serve for transfer or torque and for easy release. As a result, handling is simplified, since the operator can couple the capsule anchor with the setting tool in multiple positions, in particular in twice as many positions.

Preferably, a circumferential chamfer is arranged on the bottom of the recess. The behavior of the setting tool during transfer of an impact is positively influenced by way of the chamfer. When the drive head of a capsule anchor is inserted into the setting tool, the head will bump up against the chamfer of the recess during percussion operation. In this regard, the shape and type of chamfer define the plastic deformation behavior of the drive head. The setting tool is structured to be extra harder, so that deformation is prevented. In the case of a transfer of impact, the material of the capsule anchor can flow into the free interstice between the bottom of the recess and the drive head of the capsule anchor. In this way, it is prevented that the drive head of the capsule anchor and the setting tool deform plastically in such a manner that they wedge into one another. In this case, the drive head does not come to rest on the bottom of the recess; however, tilting of the capsule anchor sideways is nevertheless prevented, since a circumferential edge of the drive head comes to lie uniformly against the contour of the recess.

For example, the chamfer has an angle between 40° and 50° relative to the bottom of the recess. Particularly preferably, the chamfer has an angle of 45° relative to the bottom of the recess. As a result, a cone angle of 90° occurs for the recess. Such a cone angle has a particularly positive influence on the setting performance of the system, particularly during percussion operation. The forces that occur during percussion operation are distributed homogeneously, so that neither the setting tool nor the drive head is exposed to stress peaks, which would promote plastic flow of the corresponding material.

The task is furthermore accomplished, according to the invention, by means of a set for a setting tool system for setting capsule anchors, having an adapter, which can be coupled with a drive machine, and at least one setting tool of the type mentioned above.

Such a set has the advantage that the geometry of the setting tool does not have to correspond to the geometry of a corresponding holder of the drive machine, but rather that the setting tool can be coupled with the drive machine by means of the adapter. For this purpose, the setting tool and the adapter can be connected with one another, for example by means of a force-fit or shape-fit connection.

According to a preferred embodiment, the set has multiple setting tools, for example at least two, in particular at least four setting tools. In this way, the set can have multiple setting tools for a connection with capsule anchors having different configurations, in particular with regard to the size of the anchor rod of the capsule anchors or with regard to the drive head.

The connection sections of the multiple setting tools can be configured to be different in size. In this way, the setting tools can be coupled with capsule anchors having different sizes. According to a preferred embodiment, the set can have multiple setting tools, which can be connected, in each instance, with a capsule anchor having the size M8, M10, M12, and M16. In this regard, the setting tools have connection sections that correspond to this.

For example, the adapter has an SDS insertion end, in particular an SDS-Plus or SDS-Max insertion end. By means of the SDS insertion end, the adapter can be connected with a correspondingly configured drive machine that has an SDS holder. The term "SDS" refers to a drill shaft system for percussive and rotating machine tools such as drills and hammer drills, in particular cordless drills. In the case of this insertion system, the shaft is provided with special grooves that guarantee better transfer of force and, at the same time, percussion. In contrast to other insertion systems, the SDS shaft allows tool-free and rapid changing of drill bits and chisels. Instead of the term SDS-Plus or SDS-Max, the abbreviation TE-C or TE-Y is also frequently used.

According to a preferred embodiment, the adapter has a holding section at an end opposite the insertion end for holding the setting tool. The setting tool can thereby be coupled with the drive machine by way of the adapter.

The holding section has a thread, for example, in particular an inside thread. The inside thread can correspond to the thread of the setting tools in the threaded section, so that the setting tools can be screwed together with the adapter, so that it is connected with shape fit or force fit. The setting tool can thereby be connected with the adapter in reliable but nevertheless releasable manner. The setting tools can easily be changed, in that they are screwed onto or unscrewed from the adapter. In this regard, all the setting tools of the set have a threaded section that corresponds to the thread of the holding section. Setting tool and adapter are configured in such a manner that in interplay, a guide for screwing the thread in occurs. As a result, it is prevented that the thread is tilted.

Furthermore, a setting tool system is indicated, comprising a setting tool that is configured as described above, or a set having a corresponding setting tool and an adapter, which is configured as described above, as well as a capsule anchor and/or a drive machine. By means of the setting tool system, all the components required for setting one or more capsule anchors are made available to a user. The drive machine can be a hammer drill, a cordless drill or, in general, a drill/screwdriver.

BRIEF DESCRIPTION OF DRAWINGS

Further characteristics and advantages of the invention are evident from the following description and from the following drawings, to which reference is made. In the drawings, the figures show.

DETAILED DESCRIPTION OF THE INVENTION

Figure 1:
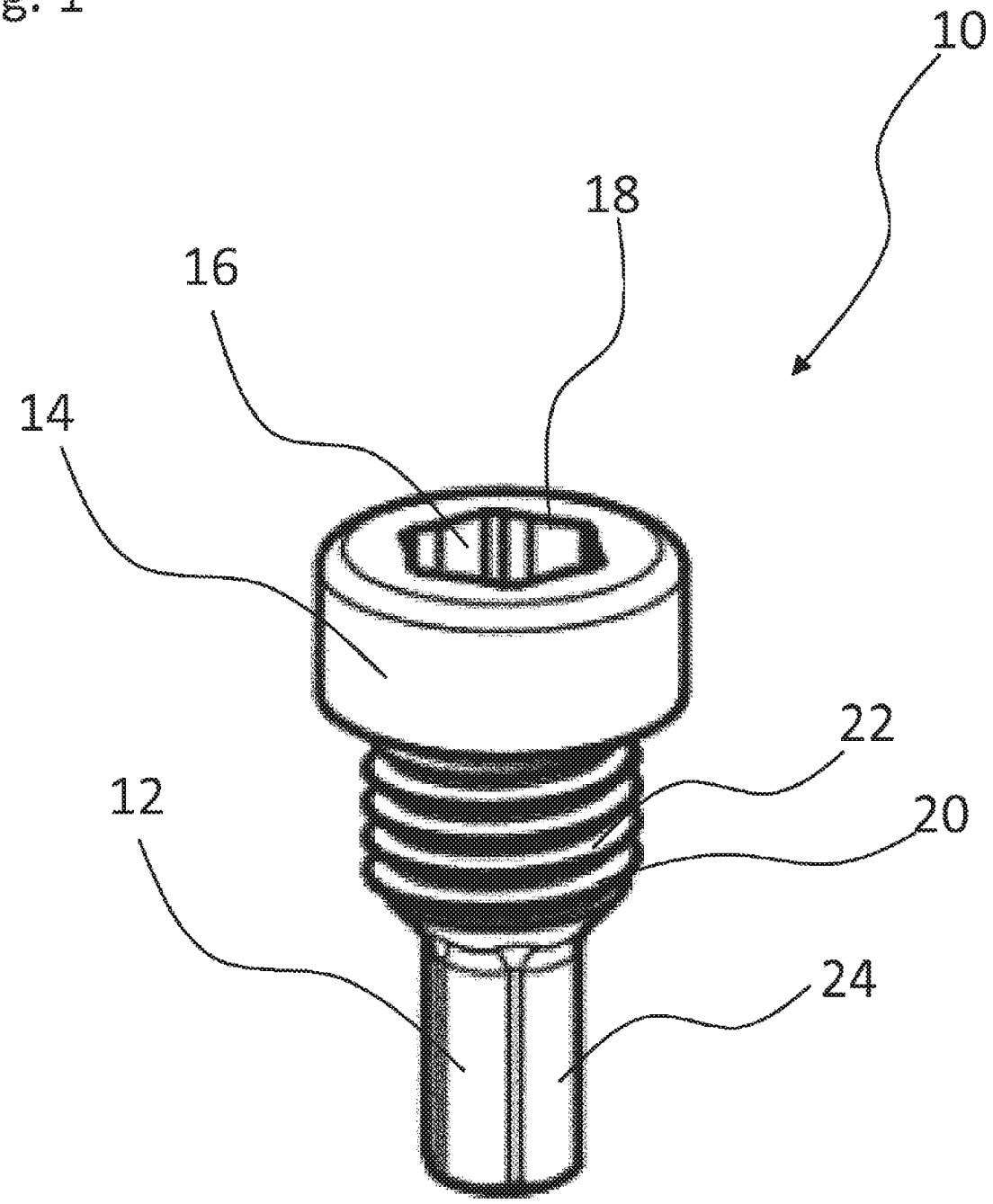
FIG. 1 a setting tool according to the invention.

FIG. 1 shows a setting tool 10 for setting capsule anchors. The setting tool 10 has a shaft 12 and a head 14 arranged at one end of the shaft 12.

A connection section 16 is arranged on the head 14, wherein the connection section 16 comprises a recess 18. The connection section 16 is particularly formed by the recess 18. The recess 18 is a depression having a hexagonal profile; in particular, the recess 18 has a hexagonal socket geometry.

In general, the connection section 16 or the recess 18 is arranged in the end face of the head 14, which faces away from the shaft 12.

An end of the capsule anchor can be inserted into the recess 18, in particular with shape fit, which end is also referred to as a drive head. As a result, a drive torque can be transferred from the setting tool 10 to the capsule anchor. For this purpose, the capsule anchor has a corresponding external hex geometry on an anchor rod, which is coupled with a capsule, as will still be explained below.

The shaft 12 has a threaded section 20 having a thread 22 and a thread-free section 24. In this regard, the thread-free section 24 can serve to directly connect the setting tool 10 with a drive machine, not shown here. For this purpose, the thread-free section 24 has a hexagonal profile, in particular a hexagon profile, by means of which the setting tool 10 can be coupled with a three-jaw chuck of the drive machine, for example. Alternatively, the thread-free section 24 can also have a quadrangular profile, in particular a square profile.

Figure 5:
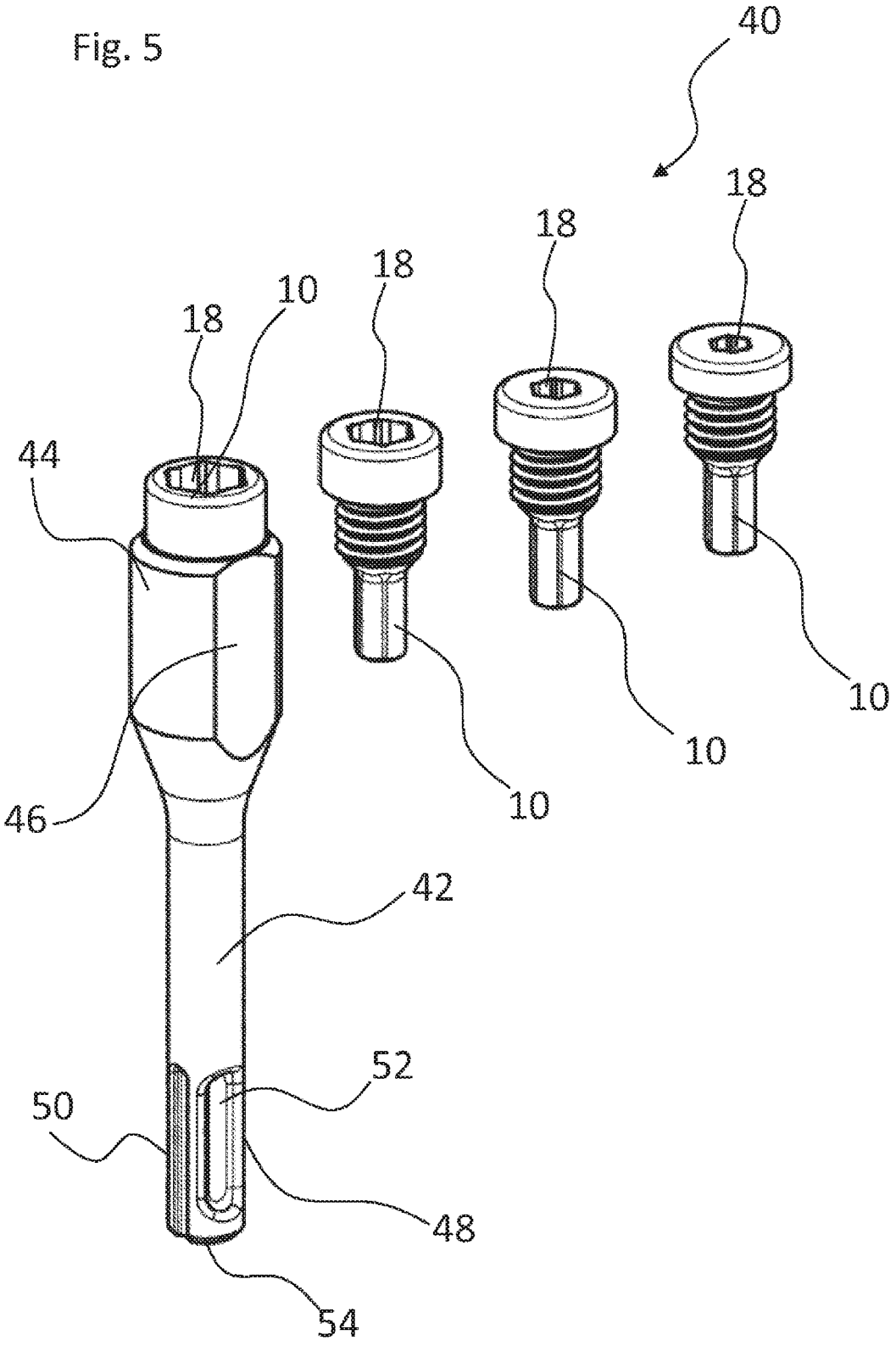

By means of the threaded section 20, the setting tool 10 can be connected with an adapter shown in FIG. 5, in particular screwed into it. The adapter is used, above all, if the geometry of the thread-free section 24 does not agree with the geometry of the holder of the drive machine. Furthermore, further functions can be made available by way of the adapter, as will still be explained below.

The setting 10 accordingly has essentially three regions, namely the connection section 16 at a first end, the threaded section 20 that follows it, as well as the thread-free section 24 at the other end, by way of which the setting tool 10 can be directly connected with a drive machine. These three sections 16, 20, 24 make a transition into one another.

Figure 2:
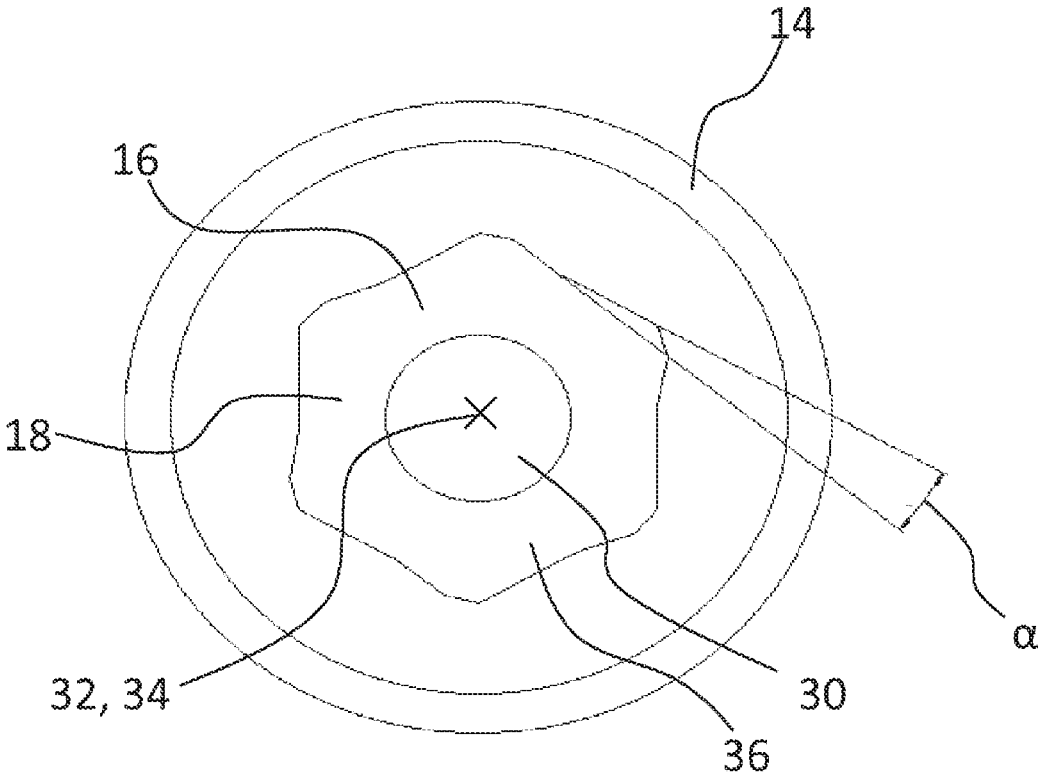
FIG. 2 the head of a setting tool from FIG. 1 in a top view.

FIG. 2 shows the head 14 of the setting tool 10 from FIG. 1 in a top view.

In the top view, the shape of the recess 18 of the connection section 16 can be seen. The shape of the recess 18 is essentially formed by two partial recesses 26, 28, which each have a base surface in the shape of a hexagon, which hexagons are superimposed and offset from one another.

Figure 3:
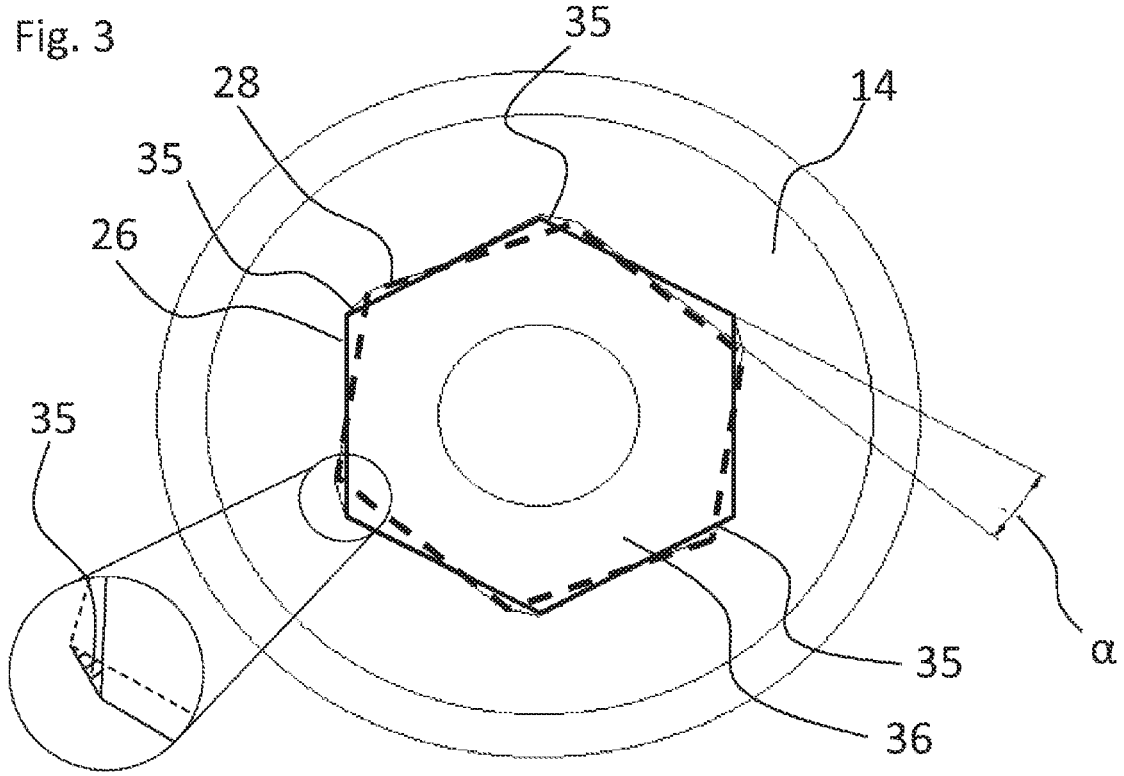
FIG. 3 the head of the setting tool from FIG. 1 in a view that illustrates the shape of the recess, FIG. 4 a head of the setting tool from FIG. 1 in a side view, FIG. 5 a set according to the invention having multiple setting tools according to FIG. 1, and FIG. 6 a setting tool system according to the invention.

For a better understanding, the two hexagonal partial recesses 26, 28, which together define the shape of the recess 18, are indicated differently in FIG. 3, wherein the first hexagonal partial recess 26 is shown with a solid line, and the second hexagonal partial recess 28 is shown with a broken line. In this regard, the recess 18 is formed by the two partial recesses 26, 28, having the hexagonal base surfaces, which are merged with one another.

The partial recesses 26, 28 are arranged offset from one another in a common plane, which means that the bottoms 30 of the two partial recesses 26, 28 are arranged in a common plane, which runs perpendicular to a center axis of the setting tool 10.

The center points 32, 34 of the partial recesses 26, 28, in other words of the respective hexagons, lie one on top of the other. Furthermore, the center points 32, 34 lie on the center axis of the setting tool 10. Therefore the center points 32, 34 are arranged centered in the head 14 of the setting tool 10.

In the embodiment shown, the partial recesses 26, 28 are arranged rotated relative to one another by an angle $\alpha$ of 10°. In this regard, the hexagonal base surfaces of the partial recesses 26, 28 are rotated relative to one another by the angle $\alpha$.

In general, the angle $\alpha$ can amount to between 5° and 15°, in particular between 8° and 13°. In this regard, the center axis of the setting tool 10 forms the axis of rotation about which the two partial recesses 26, 28, in other words their hexagonal base surfaces, are rotated relative to one another. In FIGS. 2 and 3, the center axis of the setting tool 10 runs perpendicular to the plane of the drawing, specifically through the center points 32, 34 of the hexagons of the partial recesses 26, 28.

In the embodiment shown, the partial recesses 26, 28 each have a hexagonal base surface, which is equilateral and regular. In particular, the partial recesses 26, 28 are configured as a hexagonal socket, in each instance.

In the case of superimposition of the partial recesses 26, 28, which are rotated relative to one another, in particular of their base surfaces, peaks that point inward occur between the corner points of the base surfaces; these are flattened off, since otherwise they would promote wedging of a capsule anchor in the setting tool 10.

In this regard, regions 35 are also removed; these regions are defined by the connection of directly adjacent corners of the two hexagonal base surfaces of the partial recesses 26, 28 as well as the sides of the two hexagons that run toward one another up to their intersection point, in each instance. This is illustrated dearly in FIG. 3, in which the corresponding regions 35 are shown cross-hatched in a magnified detail, to identify them. As has already been explained, these regions 35 or the corresponding peaks that project inward are flattened off, so that the regions 35 are also part of the recess 18.

The circumference radii of the hexagonal base surfaces of the partial recesses 26, 28, on which all the corner points of the hexagons lie, can have different sizes. As a result, a shape-fit connection between a setting tool 10 and a drive head of a capsule anchor is produced, and this improves the quality of the shape fit. At the same time, the setting tool 10 can be easily released from the capsule anchor after a setting procedure, even if the drive head of the capsule anchor might have been plastically deformed during the setting process. Due to the different sizes of the partial recesses 26, 28, the contour of one partial recess 26, 28 can serve for holding the capsule anchor, whereas the other partial recess 26, 28 serves for easy release of the capsule anchor after it has been set.

Alternatively, the two partial recesses 26, 28 can also be the same size, in terms of surface area, in other words their hexagonal base surfaces can have the same circumference radii. Accordingly, the contours of both partial recesses 26, 28 serve both for holding the capsule anchor and for easy release of the capsule anchor.

Figure 4:
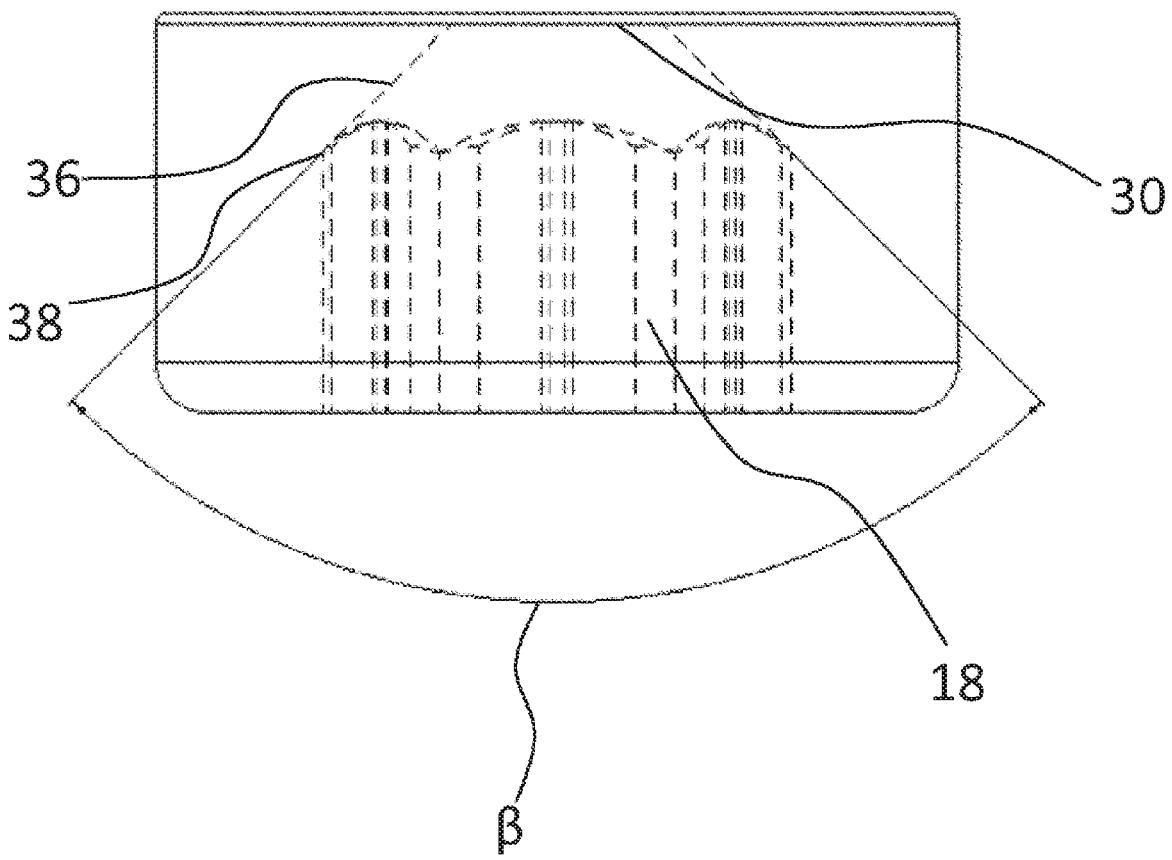

FIG. 4 shows the head 14 of the setting tool from FIG. 1 in a side view.

A circumferential chamfer 36 is arranged proceeding from the bottom 30 of the recess 18, as is already evident from FIGS. 2 and 3. The chamfer 36 has an angle of 45° from the bottom 30 of the recess 18; this results in a cone angle β of the recess 18 of 90°. In the case of such a cone angle β, the setting performance of the setting process is particularly high.

In particular, the chamfer 36 or the cone angle β of the recess 18 serves to improve the setting behavior during percussion operation, as will still be explained below.

FIG. 5 shows a set 40 for setting capsule anchors, consisting of an adapter 42 and four different setting tools 10. The recesses 18 of the respective setting tools 10 are configured in different sizes. As a result, each setting tool 10 can be coupled with a specific capsule anchor, which has a size that corresponds to the corresponding recess 18 of the setting tools 10. For example, the setting tools 10 that are shown can be coupled with capsule anchors having the thread sizes M8, M10, M12, and M16.

The shaft 12, in particular the threaded section 20 and the thread-free section 24, can be configured identically in the case of each of the setting tools 10. As a result, all the setting tools 10 can be connected with the one adapter 42.

In order to connect a setting tool 10 with the adapter 42, the setting tool 10 can be screwed onto the adapter 42 by means of the threaded section 20. For this purpose, the adapter 42 has a thread that corresponds to the threaded section 20 on its holding section 44. This thread is configured as an inside thread, which corresponds to the outside thread of the threaded section 20 of the respective setting tool 10. The thread of the adapter 42 cannot be seen in FIG. 2, since a setting tool 10 is already shown in connection with the adapter 42.

In this regard, a shape-fit or force-fit threaded connection is produced between the setting tool 10 that is being used and the adapter 42.

Since the setting tools 10 are coupled with the adapter 42 by way of the corresponding threaded section 20, in each instance, it is sufficient if the threaded sections 20 of the different setting tools 10 are configured to be the same, in each instance. With regard to the thread-free sections 24 of the setting tools 10, it merely has to be ensured that these can be held in the adapter 42.

At one end of the adapter 42, on which the thread of the adapter 42 is also arranged, the adapter 42 has at least one key surface 46, which is configured as an outside flattened part on the adapter 42. This key surface 46 serves for being able to release the setting tool 10 in simple manner, for example using a corresponding tool.

The adapter 42 furthermore has an insertion end 48, which is provided on the end that lies opposite the holding section 44. The adapter 42 can be coupled with a drive machine using the insertion end 48. Here, the insertion end 48 is configured as an SDS-Plus insertion end. Optionally, this can also be structured as an SDS-Max insertion end, in particular in order to be able to hold setting tools with which anchor rods having a size of M20 or greater can be set. In this regard, SDS describes an insertion system in which the insertion end 48 is provided with special grooves, which guarantee better transfer of force and, at the same time, percussion. In particular, the insertion end 48 has two longitudinal grooves 50, which extend in the longitudinal direction of the adapter 42 all the way to the end of the adapter 42, at which the insertion end 48 is formed. In FIG. 5, only one of the longitudinal grooves 50 can be seen, since the second longitudinal groove 50 is situated on the opposite side of the adapter 42. The adapter 42 can be inserted into a drive machine with shape fit by means of the longitudinal grooves 50, in accordance with the key/hole principle, and thereby a torque can be transferred from a drive machine to the adapter 42.

In addition, the adapter 42 has two further grooves 52, provided on opposite surfaces, which grooves have a distance from the end face 54 of the adapter 42 at the insertion end 48. The grooves 52 serve to limit the axial movement of the adapter 42 in a drive machine, in particular during percussion, in that rollers or balls that are mounted in the drive machine engage into the grooves 52. Furthermore, the grooves 52 can contribute to the transfer of torque.

Figure 6:
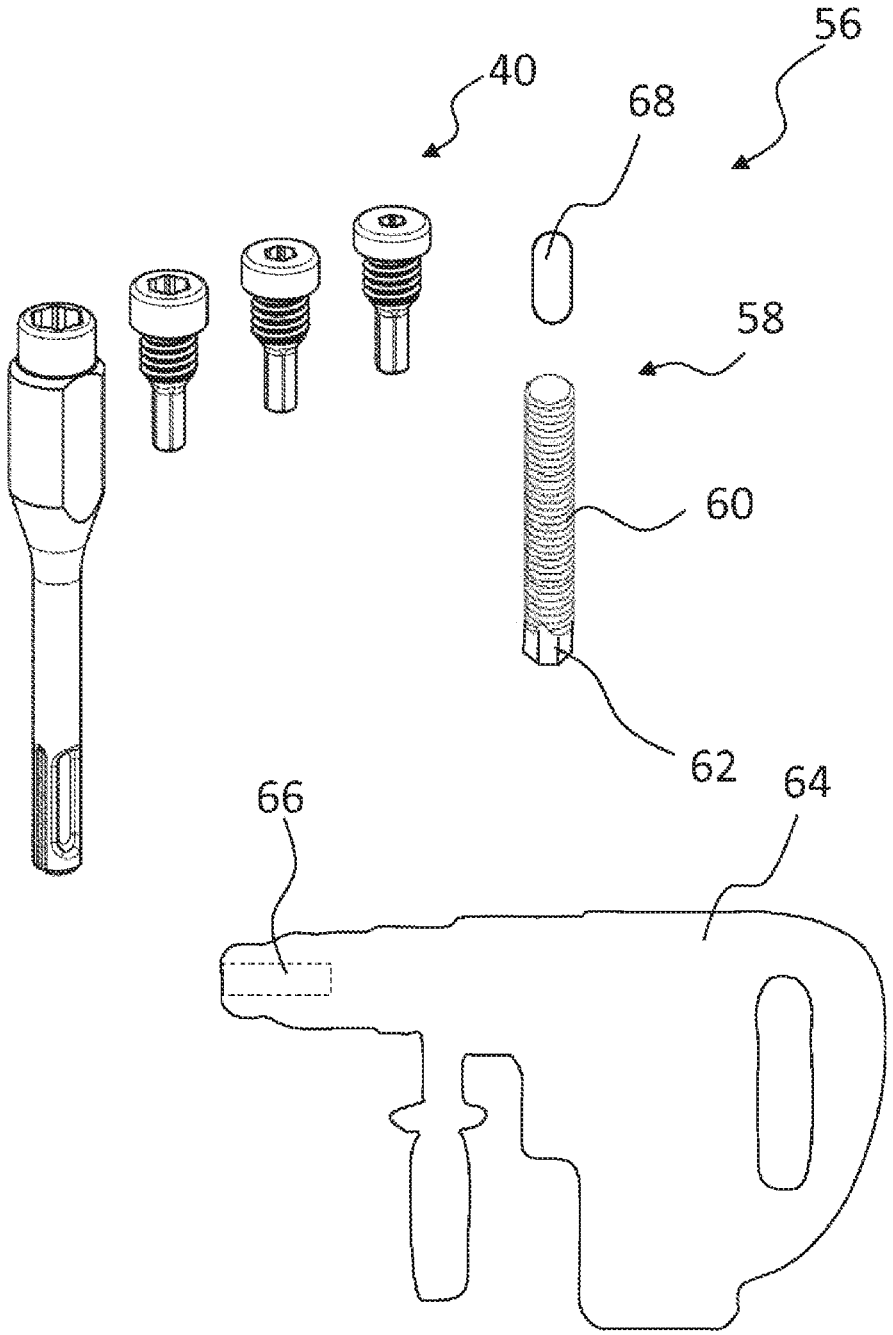

FIG. 6 shows a setting tool system 56 having a set 40 according to FIG. 5 or at least one setting tool 10 according to FIG. 1, as well as a capsule anchor 58. The capsule anchor 58 has an anchor rod 60 as well as a capsule 68, in which the at least two components are accommodated. The anchor rod 60 has a drive head 62, which is configured as an external hex.

Accordingly, the anchor rod 60 can be coupled, by way of the drive head 62, with a correspondingly configured setting tool 10, in other words a setting tool 10 having a recess 18 that matches the geometry of the drive head 62.

In addition, the setting tool system 56 can have a drive machine 64, shown schematically, for example a drill/screwdriver or a hammer drill. The drive machine 64 has a holder 66 for the adapter 42. Alternatively or supplementally, the setting tools 10 can be directly inserted into the holder 66 by way of the respective thread-free section 24.

In general, first a hole is introduced into a substratum into which the capsule anchor 58 is to be introduced, for example a borehole. Subsequently, this borehole can be cleaned.

Then the capsule 68 is inserted into the hole to fasten the capsule anchor 58 in place; at least two components are contained in the capsule, which components react with one another if they are mixed with one another. This is implemented in that the capsule anchor 58, in particular its anchor rod 60, is introduced into the borehole that has been provided with the capsule 68, while being rotated, wherein the capsule 68 breaks or tears and releases the at least two components. Due to the rotation of the capsule anchor 58 or of the anchor rod 60, the two components are mixed and react chemically with one another. After the mixture has cured, the capsule anchor 58 is held in the borehole with force fit and shape fit.

As a function of the borehole and/or of the capsule anchor 58, the corresponding setting tool 10 is used, so that a recess 18 that is suitable for the drive head 62 of the capsule anchor 58 is provided in the selected setting tool 10.

Alternatively to separate configuration of the anchor rod 60 and of the capsule 68, the capsule 68 can also be arranged integrally on the anchor rod 60, so as to form an integral capsule anchor 58.

As has already been explained, the chamfer 36 or the cone angle β of the recess 18 serves to improve the setting behavior during percussion operation. In this regard, the recess 18, in particular by way of its chamfer 36, and the drive head 60 make contact with one another, and thereby plastic deformation of the corresponding materials can occur.

Due to the cone angle that has been set, β=90°, however, this is reduced to the greatest possible extent, and thereby it is also ensured that the capsule anchor 58 does not become wedged in the recess 18 of the setting tool 10. In this regard, the setting tool and the capsule anchor 58 can easily be released from one another, so that a further capsule anchor 58 can quickly be set.

Because of the circumferential chamfer 36 at the bottom 30 of the recess 18, a capsule anchor 58 cannot be introduced into the recess 18 completely, but rather only up to an upper edge 38 of the chamfer 36, in particular up to the beginning of the chamfer 36. If, therefore, a capsule anchor 58 is inserted into the recess 18 of the setting tool 10, a cavity occurs between the head of the capsule anchor 58 and the bottom 30 of the recess 18. In the case of a transfer of percussion onto the capsule anchor 58, the material of the same can flow into this cavity in the case of plastic deformation. It is thereby prevented that too much material is forced into the small interstice between the drive head 62 of the capsule anchor 58 and a side wall of the recess 18, which could lead to the result that the capsule anchor 58 becomes wedged in the recess 18.

Due to the set 40 or the setting tool system 56, it is furthermore possible to set a capsule anchor 58 having a different size, in correspondingly rapid manner, since the correspondingly assigned setting tool 10 can quickly be changed.

The invention claimed is:

1. A setting tool for a setting tool system for setting capsule anchors, comprising:

a shaft, wherein the shaft has a threaded section; and a head comprising:

a bottom and, a circumferential side wall, wherein the bottom comprises a first face and a second face, wherein the second face is opposite and parallel to the first face, wherein the shaft abuts the first face, and wherein a recess is defined by the second face and an inside of the circumferential side wall, wherein the recess is for holding a drive head of a capsule anchor, wherein a shape of a top portion of the recess is formed by two hexagons that are superimposed on one another and arranged offset relative to one another, and wherein a shape of a bottom portion of the recess is defined by the second face and a circumferential chamfer that is arranged on the inside of the circumferential wall.

2. The setting tool according to claim 1, wherein center points of the two superimposed hexagons lie one on top of the other.

3. The setting tool according to claim 1, wherein the hexagons are arranged rotated relative to one another by an angle between 5° and 15°.

4. The setting tool according to claim 1, wherein each of the hexagons are configured to be equilateral.

5. The setting tool according to claim 1, wherein each of the hexagons form a recess configured as a hexagonal socket.

6. The setting tool according to claim 1, wherein the circumferential chamfer has an angle between 40° and 59° relative to the bottom of the recess.

7. A set for a setting tool system for setting capsule anchors, comprising:

an adapter that can be coupled with a drive machine, and at least one setting tool according to claim 1.

8. The set according to claim 7, wherein the set has multiple selling tools.

9. The set according to claim 8, wherein the recesses of the multiple selling tools are configured to be different in size.

10. The set according to claim 7, wherein the adapter has an SDS insertion end.

11. The set according to claim 10, wherein the adapter has a holding section at an end opposite the insertion end for holding the setting tool.

12. A setting tool system, comprising:

(a). the setting tool according to claim 1, or (b). a set comprising an adaptor that can be coupled with a drive machine, and at least one setting tool according to claim 1, and a capsule anchor, and/or a drive machine.

13. The setting tool according to claim 1, wherein the threaded section is disposed between a thread-free section and the head.

* * * * *